US011248392B1

(12) United States Patent
Gray

(10) Patent No.: US 11,248,392 B1
(45) Date of Patent: Feb. 15, 2022

(54) IMAGE MOUNTING PLATE FOR A DOOR

(71) Applicant: Rodger Francis Gray, Conway, SC (US)

(72) Inventor: Rodger Francis Gray, Conway, SC (US)

( * ) Notice: Subject to any disclaimer, the term of this patent is extended or adjusted under 35 U.S.C. 154(b) by 0 days.

(21) Appl. No.: 17/302,117

(22) Filed: Apr. 23, 2021

Related U.S. Application Data

(60) Provisional application No. 63/200,251, filed on Feb. 24, 2021.

(51) Int. Cl.
*E05B 9/00* (2006.01)
*E05B 9/06* (2006.01)

(52) U.S. Cl.
CPC ..... *E05B 9/002* (2013.01); *Y10T 292/91* (2015.04)

(58) Field of Classification Search
CPC .... Y10S 292/53; Y10S 292/54; Y10S 292/64; Y10T 292/91; E05B 9/002; E05B 1/0084; E05B 15/02; E05B 3/06
USPC ..... 40/331, 599, 661.12; 292/357
See application file for complete search history.

(56) References Cited

U.S. PATENT DOCUMENTS 924,801 A * 6/1909 Lockwood ..... E05B 15/02 70/452
1,653,513 A * 12/1927 Schlage ..... E05B 15/02 292/357
1,741,653 A * 12/1929 Palmer ..... E05B 15/02 70/452
1,819,611 A * 8/1931 Martin ..... A47B 95/02 16/419
2,828,153 A * 3/1958 Ahlquist ..... E05B 3/06 292/357
3,107,113 A * 10/1963 Sconzo ..... E05B 15/02 292/228
3,217,439 A * 11/1965 Wilhelmi ..... G05G 1/02 40/331
3,503,233 A * 3/1970 Armstrong ..... E05B 9/084 70/370
3,732,712 A * 5/1973 Miller ..... E05B 15/02 70/452
4,586,354 A * 5/1986 Smith ..... E05B 9/084 70/451

(Continued)

FOREIGN PATENT DOCUMENTS

DE 102010003007 A1 * 9/2011 ..... E05B 15/02
FR 3037986 A1 * 12/2016 ..... E05B 15/02

(Continued)

*Primary Examiner* — Carlos Lugo
(74) *Attorney, Agent, or Firm* — Dunlap Bennett & Ludwig, PLLC

(57) ABSTRACT

An image mounting plate is provided. The image mounting plate may be installed between a handle and an object supporting the handle, whereby an image on a front-facing surface of the image mounting plate is visible after installation. The image mounting plate has a void for accommodating portions of the handle that engage the object by way of a bore hole in the object. The image mounting plate has at least one elongated slot tangentially or semi-tangentially associated with its void. The present invention includes a placement guide for each elongated slot, wherein a head portion of the placement guide operatively associates with the elongated slot and a blade portion of the placement guide operatively associates with the bore hole of the object.

10 Claims, 3 Drawing Sheets

(56) References Cited

U.S. PATENT DOCUMENTS

| | | | | | |
|---|---|---|---|---|---|
| 4,790,162 | A * | 12/1988 | Thur | E05B 3/06 | 292/336.3 |
| 4,869,083 | A * | 9/1989 | DeMarseilles | E05B 55/005 | 70/224 |
| 5,084,940 | A * | 2/1992 | Loffler | E05B 1/0015 | 16/412 |
| D340,637 | S | 10/1993 | Campbell et al. | | |
| 5,263,510 | A * | 11/1993 | Heimann | E03C 1/042 | 137/359 |
| 5,883,570 | A | 3/1999 | Lusareta et al. | | |
| 6,880,872 | B2 * | 4/2005 | Eller | E05B 3/065 | 292/357 |
| 7,198,835 | B2 | 4/2007 | Anderson | | |
| 7,383,654 | B2 | 6/2008 | Olivier et al. | | |
| 8,485,615 | B2 | 7/2013 | Ciyanoglu et al. | | |
| 8,495,798 | B1 | 7/2013 | Parker | | |
| 8,746,644 | B2 | 6/2014 | Kressin | | |
| 8,960,740 | B2 * | 2/2015 | Huang | E05B 15/02 | 292/347 |
| 9,950,558 | B1 | 4/2018 | Nguyen | | |
| 2004/0043361 | A1 | 3/2004 | Bialas | | |
| 2007/0062136 | A1 | 3/2007 | Kim et al. | | |
| 2007/0069090 | A1 | 3/2007 | Driscoll | | |
| 2009/0289464 | A1 * | 11/2009 | Pawson | E05B 15/02 | 292/346 |
| 2010/0269414 | A1 | 10/2010 | Horton | | |
| 2011/0025173 | A1 | 2/2011 | Ciyanoglu et al. | | |
| 2011/0030410 | A1 | 2/2011 | Ciyanoglu et al. | | |
| 2017/0350184 | A1 | 12/2017 | Shock | | |
| 2018/0058138 | A1 | 3/2018 | Binder | | |

FOREIGN PATENT DOCUMENTS

| | | | | |
|---|---|---|---|---|
| GB | 629568 | A * | 9/1949 | E05B 3/06 |
| KR | 200431436 | Y1 * | 11/2006 | |
| KR | 20100005482 | U * | 5/2010 | |
| KR | 20180004495 | A * | 1/2018 | |

* cited by examiner

IMAGE MOUNTING PLATE FOR A DOOR

CROSS-REFERENCE TO RELATED APPLICATION

This application claims the benefit of priority of U.S. provisional application No. 63/200,251, filed 24 Feb. 2021, the contents of which are herein incorporated by reference.

BACKGROUND OF THE INVENTION

The present invention relates to interior decoration and, more particularly, an image mounting plate for door decoration that is installable behind a doorknob or handle.

Other than a coating of paint, doors are typically unadorned of any decoration that enhances the decor and/or motifs contained in the room. True, there are other types of decoration products that are permanently fastened to a door or hung at front of the door via a strap that hangs from the top of the door or the doorknob. Permanently decorations, however, are installed with screws that damaged the door and its surface. Decorations merely hung via strap are loosely held and so may obstruct the door from opening and closing properly and may be unintentionally dislodged or undesirably adjusted or unlawfully removed. Current research shows no existing door decoration product that is installed behind a doorknob.

As can be seen, there is a need for an image mounting plate for door decoration that is installed behind a doorknob.

The image mounting plate embodied in the present invention is securely installed to sit behind a doorknob. The removal and reinstallation of the doorknob is required to install the image mounting plate. Because not all doorknobs are of the same size or configuration, the mounting plate is cut with a circular opening that allows any doorknob cylinder body to pass through the image mounting plate without any interference to the proper operation of the doorknob. Furthermore, the removal and reinstallation of a doorknob requires the usage of two hands. To allow the use of two hands, placement guides are utilized to hold the image mounting plate in place in the bore hole, thereby allowing the use of two hands to reinstall the doorknob. Accordingly, the image mounting plate requires no fasteners that would permanently damage the door. This is accomplished by the use of placement guides that hold the plate in place in the doorknob bore hole.

The image mounting plate may be decorated with any image that the user/consumer desires. Thereby the decorative images of the image mounting plate can be commercialized by a manufacturer to offer the consumer a wide variety of designs and accents to complement a user's interior décor. The image mounting plate could also be utilized for imagery featuring professional sport team logos/scripting and for imagery featuring corporate branding such as logos and trademarks.

Should the user desire a different image they can remove the image mounting plate by removing the doorknob, and replace the image mounting plate and then reinstalling the doorknob.

SUMMARY OF THE INVENTION

In one aspect of the present invention, a device for installing an image to a surface of an object with a handle, the device including the following: a mounting plate; a void in the mounting plate; at least one elongated slot tangentially associated with a void perimeter of the void at a contact point; and a placement guide operatively associable with each elongated slot. By elongated, it is understood that the length of the slot is greater that its width. In certain embodiments, the length may be two to one hundred times the width.

In another aspect of the present invention, the device for installing an image to a surface of an object with a handle includes wherein each elongated slot extends on both sides of the contact point, wherein each elongated slot extends a longitudinal width that is less than a width of the void perimeter, wherein the placement guide has a head portion and a blade portion, wherein the head portion dimensioned to engage each elongated slot, wherein the blade portion is narrower than the head portion, wherein the one or more elongated slots are two elongated slots having diametrically opposing contact points along the void perimeter, wherein the void is a circle, wherein the circle has a diameter of approximately two and ⅛ inch; and including an image surface along a front surface of the mounting plate. Approximately two and ⅛ inch may be between two inches and two and one-quarter.

In yet another aspect of the present invention, a method of installing an image between a handle and an object supporting the handle by way of a bore hole in the object, the method includes mounting the above-mentioned device to the object in such a way that the two blade portions operatively associate with an inner surface of the bore hole. It being understood that the handle is removed prior to said mounting and then the handle is re-installed after mounting the device.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides an image mounting plate that may be installed between a handle and an object supporting the handle, whereby an image on a front-facing surface of the image mounting plate is visible after installation. The image mounting plate has a void for accommodating portions of the handle that engage the object by way of a bore hole in the object. The image mounting plate has at least one elongated slot tangentially or semi-tangentially associated with the void. The present invention includes a placement guide for each elongated slot, wherein a head portion of the placement guide operatively associates with the elongated slot and a blade portion of the placement guide operatively associates with the bore hole of the object.

Figure 1:
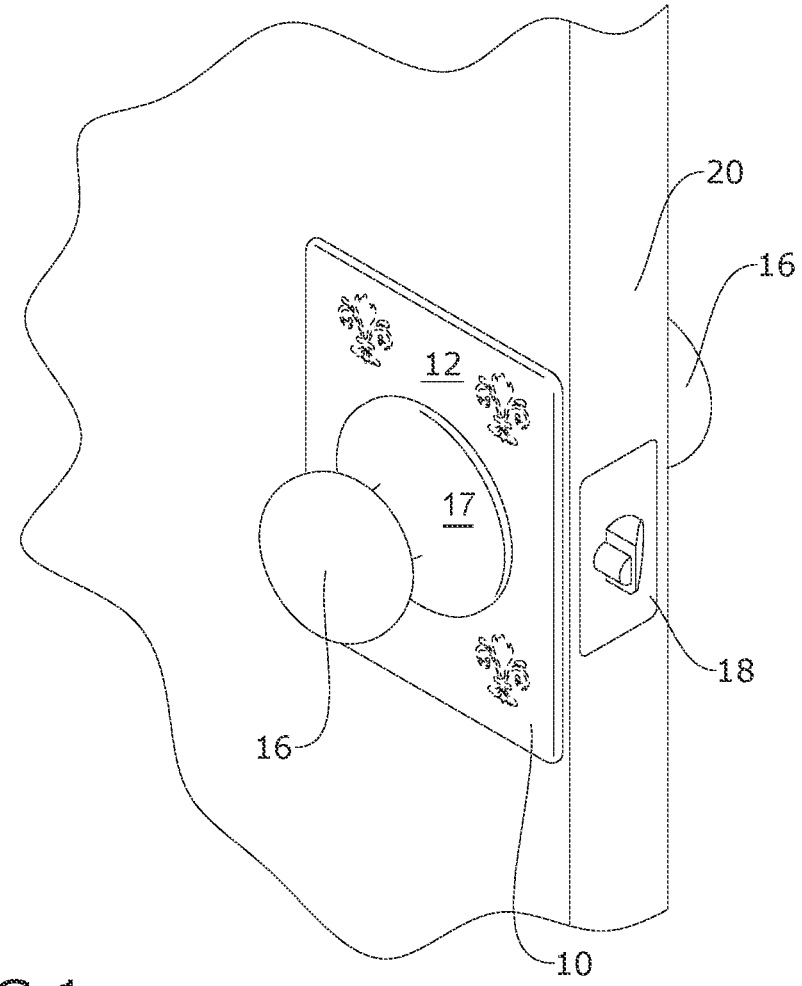
FIG. 1 is a front perspective view of an exemplary embodiment of the present invention, shown installed.
Figure 2:
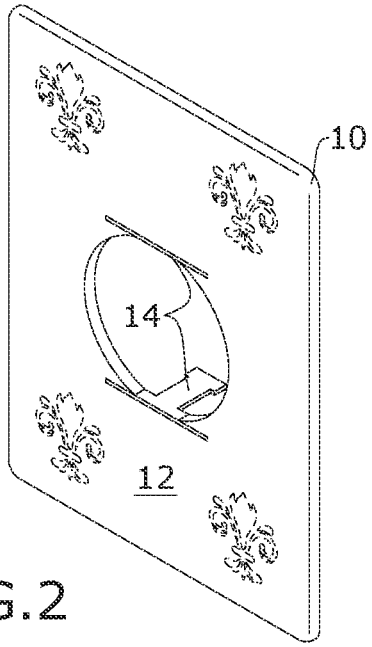
FIG. 2 is a front perspective view of an exemplary embodiment of the present invention.
Figure 3:
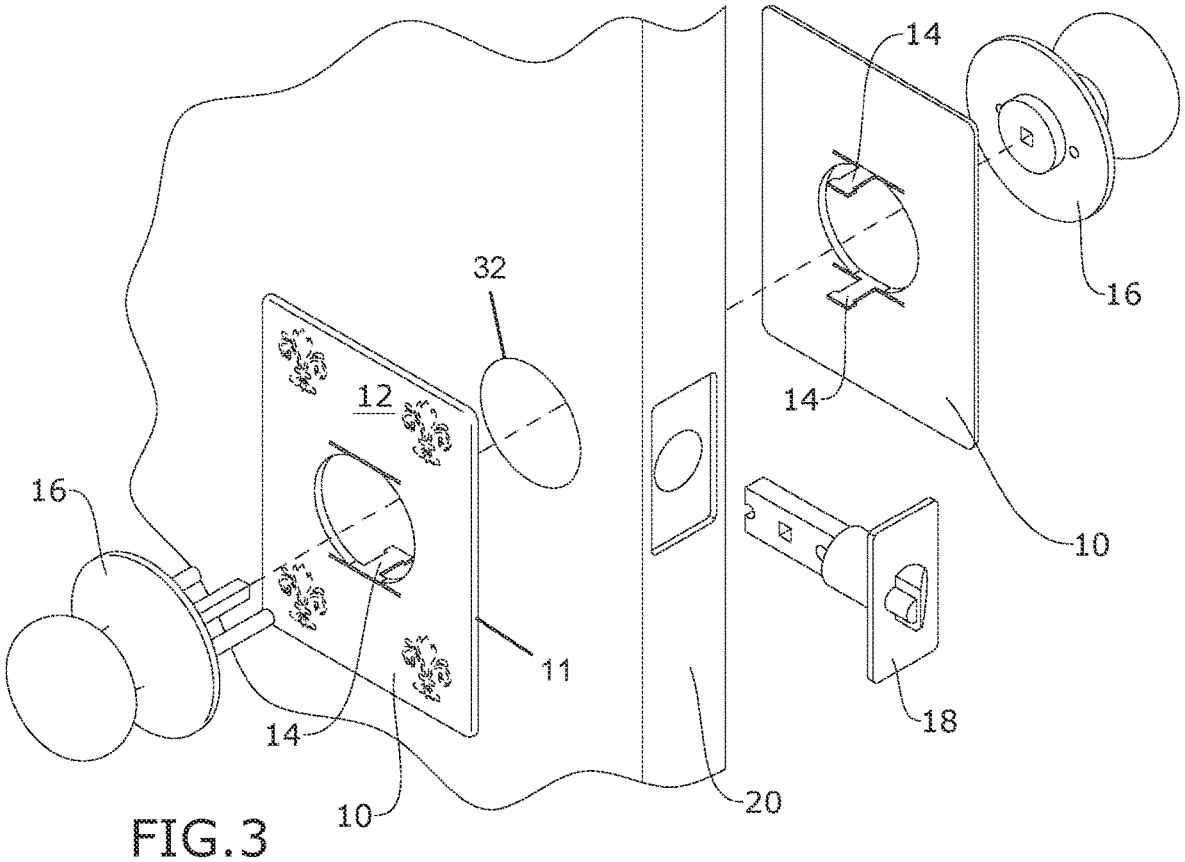
FIG. 3 is an exploded front perspective view of an exemplary embodiment of the present invention, illustrating installation.
Figure 4:
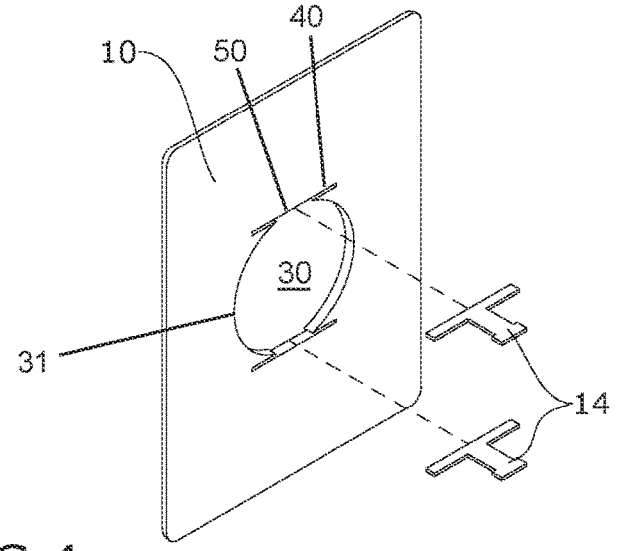
FIG. 4 is an exploded rear perspective view of an exemplary embodiment of the present invention, illustrating installation.
Figure 5:
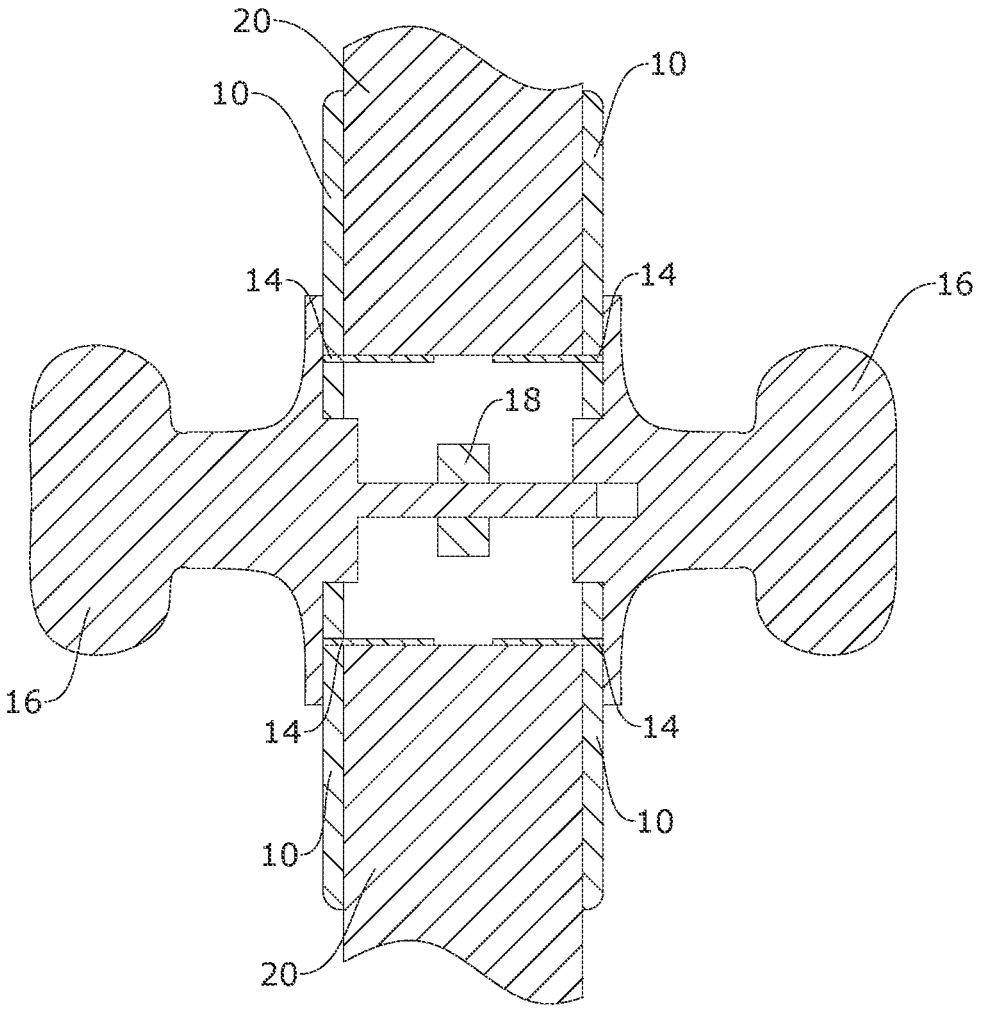
FIG. 5 is a section view of FIG. 1.
Figure 6:
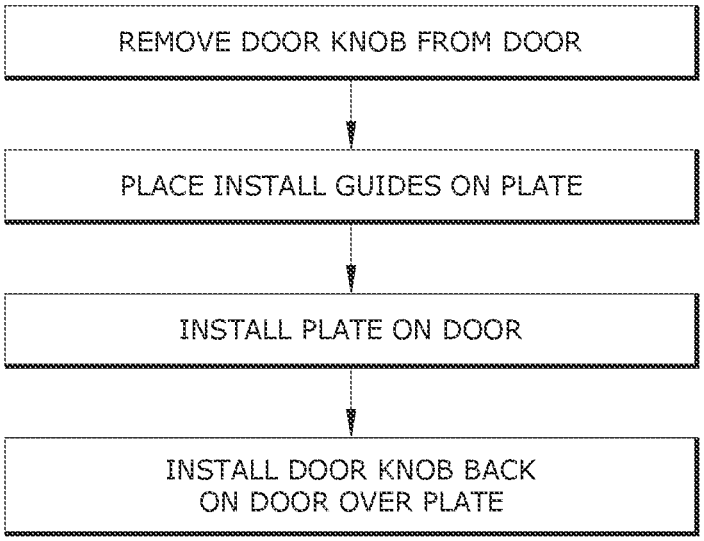
FIG. 6 is a flow chart of an exemplary embodiment of the present invention.

It should be understood by those skilled in the art that the use of directional terms such as frontward (front), rearward (rear) and the like are used in relation to the illustrative embodiments as they are depicted in the figures, the forward direction being directed away from the associated door surface, as illustrated in FIGS. 1, 3 and 5.

Referring now to FIGS. 1 through 6, the present invention may include an image mounting plate 10 for a doorknob 16. The image mounting plate 10 has a front facing image surface 12.

The image surface 12 may include, but is not limited to, a decorative image printed or represented on high quality photographic grade paper or the like. In certain embodiments the image is joined to the image surface 12 via adhesive or directly printed on the plate via UV LED printing or any other method for permanently or removably attaching an image to a substrate. In other embodiments, the image of the image surface 12 may be any form of design or message directly integrated (e.g., cold pressed or the like) with the image surface 12 or integrated with another membrane, substrate, film, or any sheet of material that is permanently or removably attached to the image surface 12.

The image mounting plate 10 may be acrylic plastic or any plasticized material, metallic material, or any material, synthetic or not, as long as that material functions in accordance with the disclosure herein. The image mounting plate 10 may be generally planar though not necessarily so. The image mounting plate 10 may have a perimetrical lip extending or curved rearward. The plate perimeter 11 may define any functional, useable shape in accordance with the disclosure herein, not just the rectangular shape shown in the Figures. The image mounting plate 10 defines a void 30 circumscribed by the plate perimeter. The void 30 has a void perimeter 31 that is mutually inclusive of a bore hole 32 of the door 20 that the image mounting plate 10 is being installed on. The void perimeter 31 may be entirely circumscribed by the perimeter of the bore hole 32, but not necessarily. The void perimeter 31 is dimensioned to receive portions of the doorknob 16 to engage the latch 18 and/or keyway of the door 20, such as but not limited to a latching mechanism.

The present invention also includes one or more placement guides 14. Each placement guide 14 may be T-shaped with a head portion (the upper portion of the T-shape) and a blade portion (the leg of the T-shape).

Tangent or semi-tangent to the void perimeter 31 may be at least one elongated slot 40. Each elongated slot 40 may be dimensioned and adapted to slidably receive the placement guide 14. Each elongated slot 40 may be disposed tangent along a portion of the void perimeter 32 mutually inclusive relative to the perimeter of the bore hole 32. As such the head portion of the placement guide 14 may be slid through or into the elongated slot 40 to snugly and securely nest therein in such a way that a blade portion occupies the bore hole 32 to secure the image mounting plate 10 thereto. The placement guide 14 may be made of malleable material, such as various plasticized materials, rubber, and the like.

Semi-tangent may mean a line (of the elongated slot 40) that touches a curved surface (void perimeter 31) at a contact point 50 and may cross that contact point 50 into the void 30. Tangent may mean the line (of the elongated slot 40) touches a curved surface (void perimeter 31) at the contact point 50 but does not cross that contact point 50 into the void 30 even though the line (of the elongated slot 40) extends on opposing sides of the point 50 (a semi-tangent line may also extend on opposing sides of the point 50).

In certain embodiments, doorknobs 16 are made by multiple providers/brands, each having different configurations, except there are one industry-wide component—they must fit in a 2⅛" bore hole 32. As a result, the placement guides 14 may be dimensioned and adapted fit a predefined 2⅛" door bore hole 32, which is the spacing of the placement guides 14, thereby affording certainty of fit of the present invention. It being understood that the present invention also contemplates and is adaptable for bore holes that are not 2⅛" and/or may not be associated with a door but any surface that an support any handle or protrusion operatively associated with the bore hole of such surface.

The image mounting plate 10 may be installed to sit behind a doorknob 16. The removal and reinstallation of the doorknob 16 is required to install the image mounting plate 10. Because not all doorknobs 16 are of the same size or configuration, the image mounting plate 10 may be cut with the void 30 that allows any doorknob cylinder body or other component to pass through the image mounting plate 10 without any interference to the proper operation of the doorknob 16. The removal and reinstallation of a doorknob 16 requires the usage of two hands. To allow the use of two hands, the placement guides 14 are utilized to hold the image mounting plate 10 in place in the bore hole 32, thus allowing the use of two hands to reinstall the doorknob 16.

The image mounting plate 10 may feature two horizontal oriented elongated slots 40 located at the 12 o'clock and 6 o'clock positions, though other (diametrically opposing or non-diametrically opposing) orientations and dispositions may also work. The elongated slots 40 hold the placement guides in the image mounting plate 10. Because doorknobs 16 are made by different manufacturers, they are not the same configuration or of a same diameter. In order for the consumer to purchase a product that is certain to fit their doorknob type; there may be two factors that may have to be met. First the one or more placement guides 14 may be spaced 2 and ⅛ inches apart (or otherwise matching the diameter width of the bore hole 32 whatever it may be). Second, the width (longitudinal length) of the elongated slot 40 must be shorter than the width of the door knob base plate 17 in such a way that one or more placement guides 14 must be hidden from sight behind the doorknob base plate 17. In certain embodiments, the positioning of the elongated slots 40 may be at 12'clock and 6 o'clock and the length of these openings satisfy both these factors. With that said, the elongated slots 40 may be at 3 o'clock and 9 o'clock. And, again, in some embodiments, there may be only one elongated slot.

A method of manufacturing the present invention may include the following. The imagery can be printed on photographic grade paper and installed on the front of the image mounting plate by use of high tack adhesive or by utilizing UV LED printing process to print the imagery directly on the image plate. After the printing process is complete; the void 30 and elongated slots 40 may be done to the image mounting plate 10 via the use of a C02 laser or a mechanical rotatory cutting tool. The placement guides are created by the use of a C02 laser or mechanical rotatory cutting tool.

A method of using the present invention may include the following. The image mounting plate 10 disclosed above may be provided. A user may remove doorknob 16, install the image mounting plate 10 as taught above, and reinstall doorknob 16.

It should be understood, of course, that the foregoing relates to exemplary embodiments of the invention and that modifications may be made without departing from the spirit and scope of the invention as set forth in the following claims.

What is claimed is:

1. A decorating device for a door, comprising:

a mounting plate defining an image surface;

a void in the mounting plate;

first and second opposed elongated slots, each elongated slot tangentially associated with a void perimeter of the void at a respective contact point; and a placement guide operatively associable with each elongated slot, wherein each placement guide is configured to engage each elongated slot, and when in use, the mounting plate is placed between a surface of the door and a handle base plate, with the void aligned with a bore defined in the door, and each placement guide is placed against an inner surface of the bore.

2. The decorating device of claim 1, wherein each elongated slot extends on both lateral sides of the contact point.

3. The decorating device of claim 2, wherein each elongated slot extends a longitudinal width that is less than a width of the void perimeter.

4. The decorating device of claim 3, wherein each placement guide has a head portion and a blade portion, wherein the head portion dimensioned to engage each elongated slot.

5. The decorating device of claim 4, wherein the blade portion is narrower than the head portion.

6. The decorating device of claim 5, wherein the contact points are diametrically opposing contact points along the void perimeter.

7. The decorating device of claim 6, wherein the void is a circle.

8. The decorating device of claim 7, wherein the circle has a diameter of approximately two and ⅛ inch.

9. The decorating device of claim 6, wherein the image surface is along a front surface of the mounting plate.

10. A method of installing an image between a handle and a door supporting the handle by way of a bore in the door, the method comprising:

mounting the decorating device of claim 9 to the door in such a way that the two blade portions operatively associate with the inner surface of the bore.

* * * * *